US011505977B2

(12) United States Patent
Miller et al.

(10) Patent No.: US 11,505,977 B2
(45) **Date of Patent: *Nov. 22, 2022**

(54) ADJUSTABLE TORSIONAL DOOR ROD

(71) Applicant: DEERE & COMPANY, Moline, IL (US)

(72) Inventors: Shaun J. Miller, Woodward, IA (US); Eric L. Baker, Indianola, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/314,424

(22) Filed: May 7, 2021

(65) Prior Publication Data

US 2021/0262261 A1 Aug. 26, 2021

Related U.S. Application Data

(63) Continuation of application No. 16/507,156, filed on Jul. 10, 2019, now Pat. No. 11,035,164.

(51) Int. Cl.
*E05F 1/08* (2006.01)
*E05D 11/10* (2006.01)

(52) U.S. Cl.
CPC ..... *E05D 11/1042* (2013.01); *E05Y 2900/531* (2013.01)

(58) Field of Classification Search
CPC ..... Y10T 16/53888; Y10T 16/5389; Y10T 16/5388; Y10T 16/54038; E05Y 2900/531;

(Continued)

(56) References Cited

U.S. PATENT DOCUMENTS 2,576,996 A 12/1951 Castedello
3,067,453 A 12/1962 Lyons
(Continued)

FOREIGN PATENT DOCUMENTS

DE 69329573 T2 5/2001
DE 10039829 B4 1/2005
DE 102010053415 A1 6/2012

OTHER PUBLICATIONS

German Search Report issued in counterpart application No. 102020207295.7 dated Nov. 3, 2020 (8 pages).

*Primary Examiner* — Chuck Y Mah
(74) *Attorney, Agent, or Firm* — Taft Stettinius & Hollister LLP; Stephen F. Rost

(57) ABSTRACT

A screen door for a cooling package of a vehicle that includes proximal and distal frame posts, screen surface, torsion bar, stationary support, torsion bracket and fastener. The proximal frame post is hingedly coupled to the cooling package, and the distal frame post can be hingedly coupled to a secondary door. Proximal end of torsion bar is fixedly attached to proximal frame post, and distal end is moveable relative to the distal frame post. Stationary support is fixedly attached to distal frame post. Torsion bracket is fixedly attached to distal end of torsion bar, and is moveable relative to stationary support. Fastener maintains torsion bracket in a desired position relative to stationary support. Movement of torsion bracket relative to stationary support applies an adjustable torsion on torsion bar, and fastener maintains the adjustable torsion. An adjustment member can be attached to fastener between torsion bracket and stationary support.

20 Claims, 5 Drawing Sheets

(58) Field of Classification Search
CPC .. E05Y 2900/606; E05F 1/123; E05F 1/1238; E05D 11/08; E05D 11/082; E05D 11/084; E05D 11/1042; E05D 1/02; G06F 1/1616; G06F 1/1681; H05K 5/0226; H02G 3/0418; H02G 3/14; B60R 16/0239
See application file for complete search history.

(56) References Cited

U.S. PATENT DOCUMENTS 3,091,819 A * 6/1963 Wheeler ..... E05F 3/104 16/86 A
3,109,194 A * 11/1963 Hay ..... E05F 1/123 16/75
3,254,452 A * 6/1966 Costantini ..... E05F 1/123 16/86 A
3,307,734 A * 3/1967 Campbell ..... B65F 1/1623 16/75
3,438,152 A * 4/1969 Cadiou ..... E05F 1/1033 16/75
3,447,191 A * 6/1969 Peters ..... E05D 11/1042 16/82
3,498,207 A * 3/1970 Hazen ..... E05F 1/002 454/194
3,699,615 A * 10/1972 Duncan ..... E05F 1/1033 16/308
4,133,074 A 1/1979 Schack
4,158,271 A 6/1979 Barry
4,223,483 A * 9/1980 Stafford ..... E05F 1/1238 49/386
4,285,098 A 8/1981 Hicks et al.
4,348,786 A 9/1982 Hirose
4,359,121 A 11/1982 Messner et al.
4,378,658 A * 4/1983 DeLorean ..... E05F 1/1238 49/386
4,785,501 A 11/1988 Obana
4,905,347 A 3/1990 Wroth
5,321,870 A 6/1994 Wada et al.
5,515,876 A 5/1996 Warner et al.
5,787,549 A 8/1998 Soderlund
6,494,280 B1 12/2002 Friend et al.
7,243,977 B2 7/2007 McIntyre et al.
7,490,888 B2 2/2009 Zagoroff
9,677,311 B2 6/2017 Shaw et al.
2002/0002884 A1 1/2002 Eromaki
2003/0025352 A1 2/2003 Duffy

* cited by examiner

ADJUSTABLE TORSIONAL DOOR ROD

CROSS-REFERENCE TO RELATED APPLICATIONS

This application is a continuation of U.S. patent application Ser. No. 16/507,156, filed Jul. 10, 2019, the disclosure of which is hereby incorporated by reference in its entirety.

FIELD OF THE DISCLOSURE

The present disclosure relates to cooling systems, and more particularly to torsion rods for counteract twisting of a screen door on a cooling system.

BACKGROUND

Many powered vehicles include an engine cooling package to cool the engine of the vehicle. The engine cooling package can include a door assembly with a screen door to filter cooling air and a secondary door. One end of the screen door can be hinged to allow it to be opened for cleaning service, and the opposite end of the screen door can be hingedly mounted to the secondary door, where the secondary door folds in conjunction with the screen door. The hinged, generally perpendicular nature of the secondary door relative to the screen door places the center of gravity of the door assembly in a cantilevered position in which a torque is applied to the screen door, which can deform the screen door, and allow the assembly to hang in a non-level fashion. In this case, closing the door assembly would require the assembly to be lifted to manually level the assembly and allow the secondary door to be placed in its home position where it is supported when closed.

It would be desirable to counteract the torque applied to the screen door when the door assembly is opened, to not deform the screen door, and not require the assembly to be manually lifted to level the assembly when closing the assembly.

SUMMARY

A screen door is disclosed for a cooling package of a vehicle. The screen door includes a proximal frame post, a distal frame post, a screen surface, a torsion bar, a stationary support, a torsion bracket and a fastener. The proximal frame post is on a proximal end of the screen door, and is hingedly coupled to the cooling package. The distal frame post is on a distal end of the screen door. The screen surface extends between the proximal and distal frame posts. The torsion bar has a proximal end fixedly attached to the proximal frame post and a distal end moveable relative to the distal frame post. The stationary support is fixedly attached to the distal frame post. The torsion bracket is fixedly attached to the distal end of the torsion bar, and the torsion bracket is moveable relative to the stationary support. The fastener maintains the torsion bracket in a desired position relative to the stationary support. Movement of the torsion bracket with respect to the stationary support applies an adjustable torsion on the torsion bar, and the fastener maintains the adjustable torsion on the torsion bar. The torsion bracket can include a fastener connection where the fastener is connected to the torsion bracket, and the fastener can maintain an adjustable distance between the stationary support and the fastener connection of the torsion bracket to maintain the adjustable torsion on the torsion bar. The stationary support can include a rod opening, and the distal end of the torsion rod can pass through the rod opening and rotate freely in the rod opening. The stationary support can include a slot, and the fastener can extend into the slot and be moveable within the slot. The screen door can also include an adjustment member that is attached to the fastener between the torsion bracket and the stationary support. The fastener can be a jack screw, and the adjustment mechanism can be a nut threaded on the jack screw. The fastener connection of the torsion bracket can be a threaded hole in the torsion bracket, and the jack screw can be threaded through the threaded hole in the torsion bracket and extend into the slot of the stationary support, and the nut can be threaded on the jack screw between the threaded hole in the torsion bracket and the slot of the stationary support.

The screen door can also include an upper frame member that extends between the proximal frame post and the distal frame post at the top of the screen surface. The upper frame member can include a top cover and one or more guides fixedly attached to the top cover, and the torsion bar can pass through the one or more guides and rotate freely in the one or more guides. The screen surface can have a pleated shape, and the upper frame member can also include front and rear covers fixedly attached to the top cover, where the front cover has a sawtooth shape that fits within the pleated shape of the screen surface on a front side of the screen surface and the rear cover has a complementary sawtooth shape that fits within the pleated shape of the screen surface on a rear side of the screen surface.

The cooling package of the vehicle can include a secondary door; and the screen door can also include an attachment mechanism connected to the distal frame post, where the attachment mechanism is configured to attach the secondary door to the distal frame post. The attachment mechanism can include a hinge and the secondary door can be hingedly attached to the distal frame post.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

An engine cooling package can include a door assembly with a screen door to filter cooling air and a secondary door. One end of the screen door can be hinged to allow it to be opened for cleaning service. The opposite end of the screen door can be hingedly mounted to the secondary door, such that the secondary door folds in conjunction with the screen door. The hinged, generally perpendicular nature of the secondary door relative to the screen door places the center of gravity of the door assembly in a cantilevered position in which a torque is applied to the screen door, which can deform the screen door, and allow the assembly to hang in a non-level fashion. In this case, closing the door assembly would require the assembly to be lifted to manually level the assembly and allow the secondary door to be placed in its home position where it is supported when closed.

Torsional rods can be fixed at the top and bottom of the screen door to counteract the induced twist of the screen door. The torsional rods can be fixedly attached or welded on one end to the door frame, and freely rotate on the other end relative to the door frame. The door frame can be manually twisted, and the torsion rods can then be secured to the door frame through a fastener, for example an adjusting screw. The torsion applied to the rod can then induce a torsion into the door frame to counteract the cantilevered weight of the secondary door.

Figure 1:
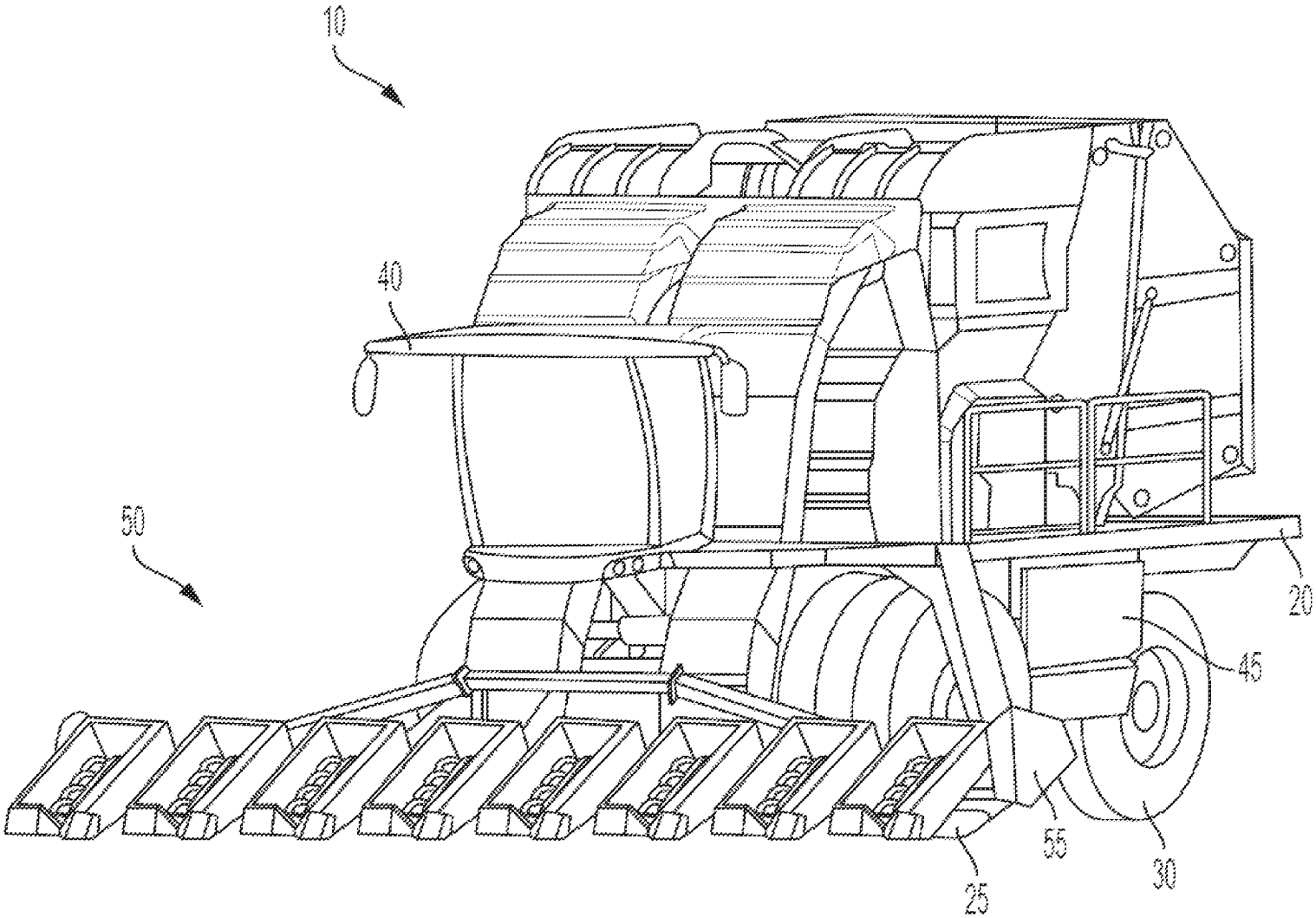
FIG. 1 illustrates an exemplary embodiment of a vehicle that includes an adjustable torsional door rod.

FIG. 1 illustrates an exemplary vehicle, in this case a cotton harvester 10. The cotton harvester 10 includes a chassis 20 supported by front wheels 25 and rear wheels 30. An operator station 40 is supported by the chassis 20, and a power module 45 may be supported below the chassis 20. A harvesting structure 50 is coupled to the chassis 20, where the harvesting structure 50 is configured to remove cotton from a field. The harvesting structure 50 includes an auger housing 55 that is adjustably supported for vertical movement relative to the ground. The power module 45 can include an engine cooling package.

Figure 2:
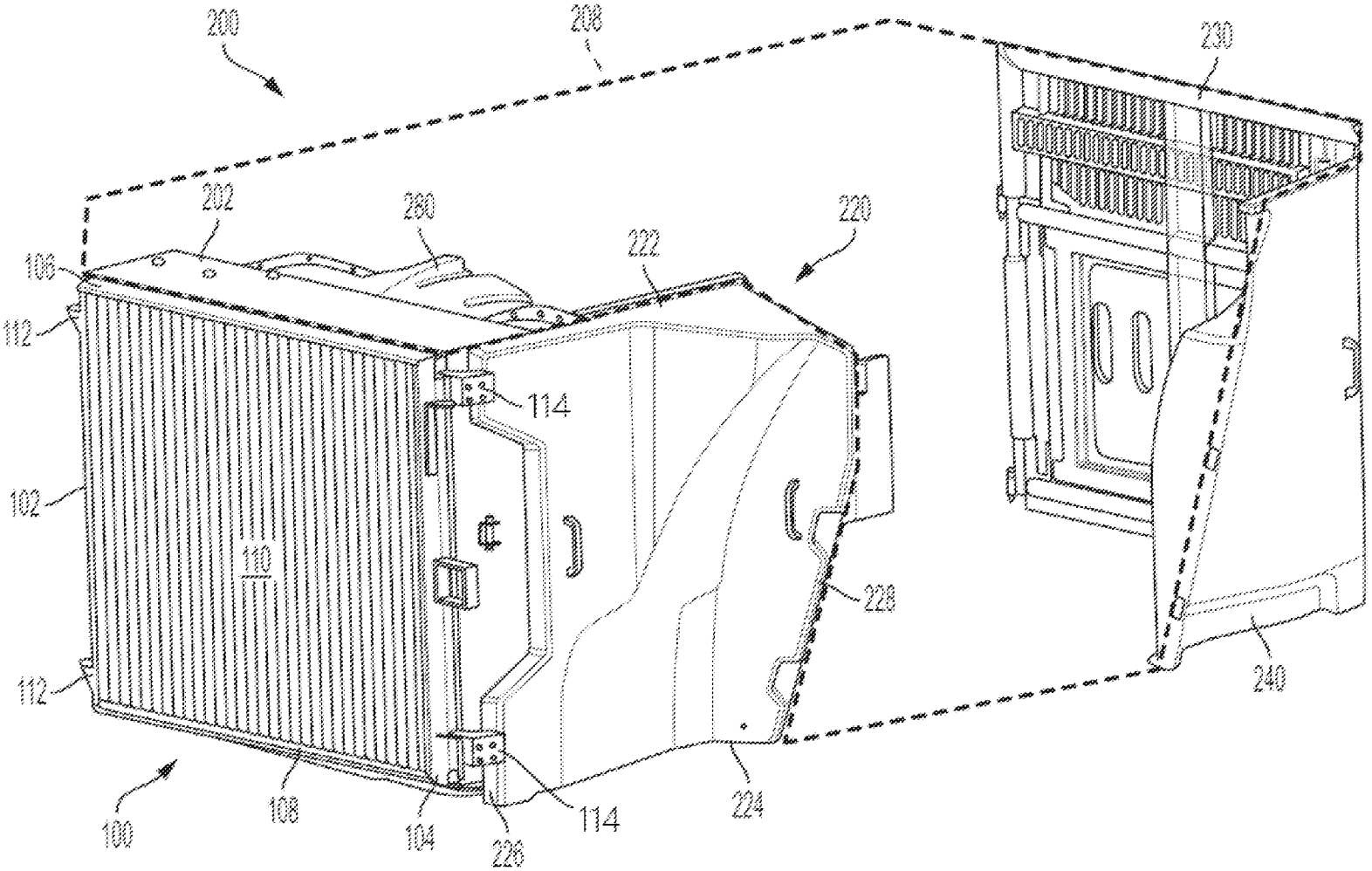
FIG. 2 illustrates a view of an exemplary engine cooling package that includes a screen door and a secondary door in a closed position, along with an opposing side door and secondary door.

FIG. 2 illustrates a view of an exemplary engine cooling package 200 which includes a screen door 100, a secondary door 220 and a structural member 202. The engine cooling package 200 can also include an opposing side door or panel 230, an opposing secondary door or panel 240, and a fan shroud 280 which covers an engine cooling fan. The screen door 100 and the opposing side panel 230 can be on opposite sides of a central portion 208 of the vehicle 10, which includes the power module 45, and the secondary door 220 and the opposing secondary panel 240 can be at the front or rear of the cooling package 200. For example, cooling air can flow across the central portion 208 of the vehicle 10 through the engine cooling package 200 between the screen door 100 and the opposing side panel 230. The secondary door 220 can be behind the right-side front wheel 25 and the opposing secondary panel 240 can be behind the left-side front wheel 25 of the vehicle 10.

Figure 3:
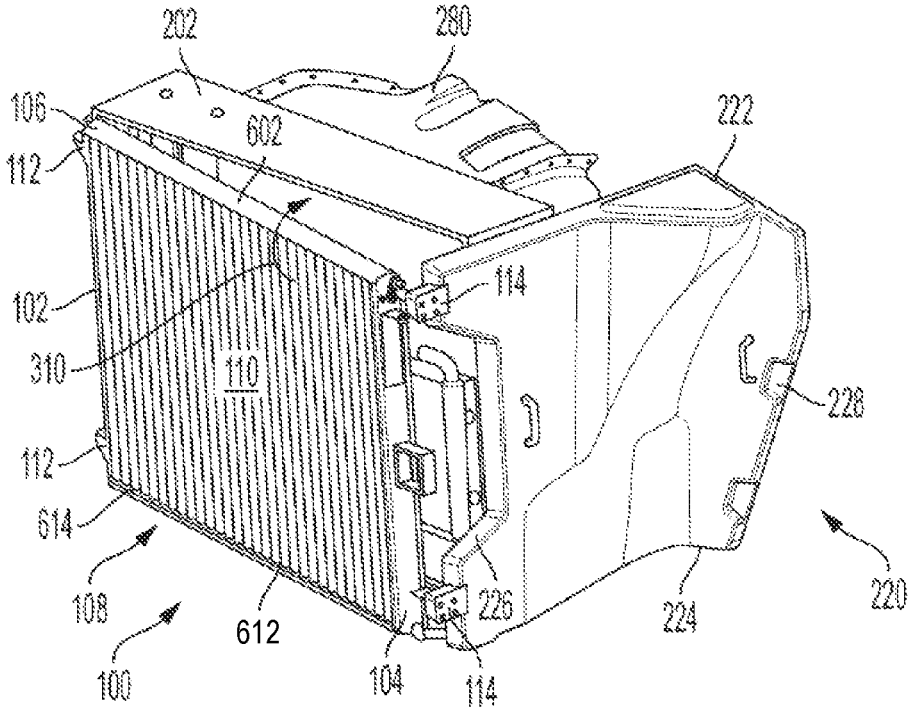
FIG. 3 illustrates a view of the screen door and the secondary door in a slightly open position.
Figure 4:
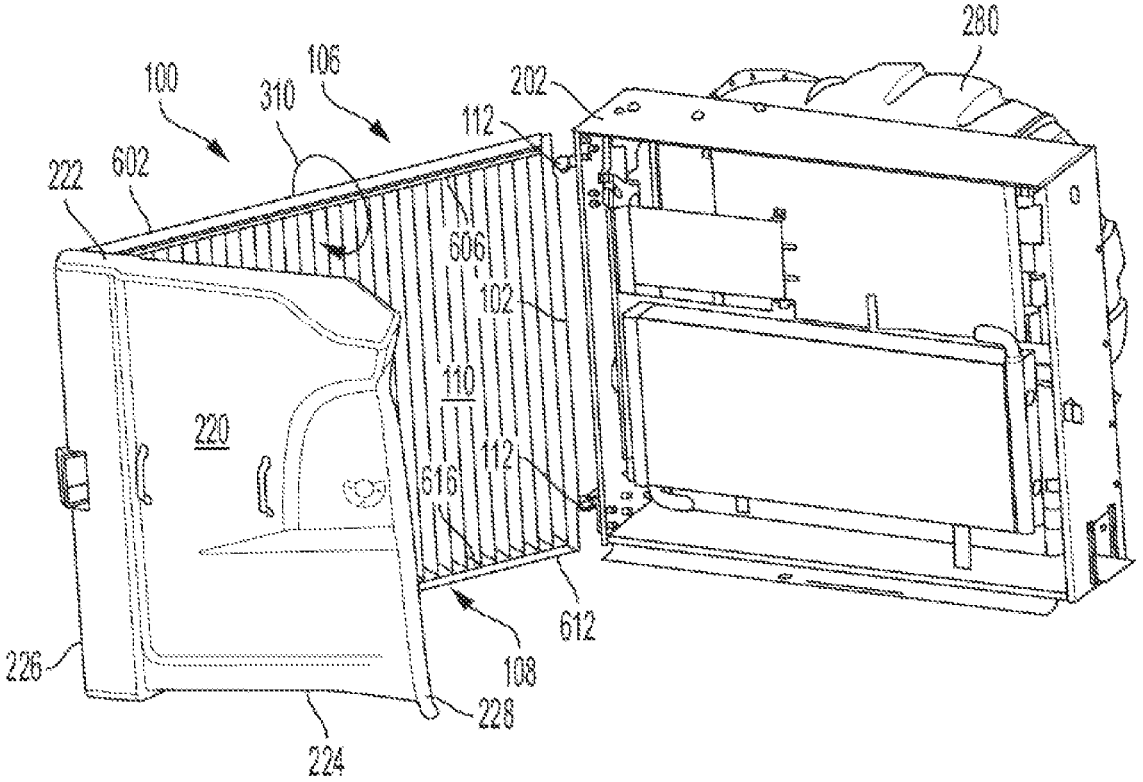
FIG. 4 illustrates a view of the screen door and the secondary door in a more fully open position.

FIG. 3 illustrates a view of the screen door 100 and the secondary door 220 in a slightly open position, and FIG. 4 illustrates a view of the screen door 100 and the secondary door 220 in a more fully open position. The screen door 100 includes a proximal frame post 102, a distal frame post 104, an upper frame member 106, a lower frame member 108, and a screen surface 110. The upper frame member 106 extends between the proximal and distal frame posts 102, 104 at the top of the screen door 100. The lower frame member 108 extends between the proximal and distal frame posts 102, 104 at the bottom of the screen door 100. The screen surface 110 extends between the proximal and distal frame posts 102, 104 and between the upper and lower frame member 106, 108 of the screen door 100.

The secondary door 220 includes a top side 222, a bottom side 224, a proximal hinged side 226 and a distal side 228. The proximal frame post 102 of the screen door 100 is fixedly hinged to the structural member 202 by one or more first hinges 112. The distal frame post 104 of the screen door 100 is hinged to the proximal hinged side 226 of the secondary door 220 by one or more second hinges 114. The structural member 202 can be coupled to the chassis 20 of the vehicle 10 such that the screen door 100 and secondary door 220 can hingedly pivot away from the vehicle 10 to provide access to the central portion 208 of the vehicle 10. The structural member 202 can have a generally rectangular shape such that the proximal and distal frame posts 102, 104 and the upper and lower frame members 106, 108 of the screen door 100 are adjacent to the structural member 202 when the screen door 100 is closed.

When the screen door 100 is in a closed position (see FIG. 2), the distal frame post 104 is adjacent to the structural member 202, which puts the proximal and distal frame posts 102, 104 and the upper and lower frame members 106, 108 of the screen door 100 adjacent to the structural member 202. When the screen door 100 is in a closed position, the secondary door 220 is generally perpendicular to the screen door 100 at the second hinges 114, and the distal side 228 of the secondary door 220 abuts against the central portion 208 of the vehicle 10.

When the screen door 100 is in an open position (see FIGS. 3 and 4), the distal frame post 104 of the screen door 100 is pulled away from the structural member 202 which pulls the upper and lower frame members 106, 108 of the screen door 100 away from the structural member 202. The proximal hinged side 226 of the secondary door 220 moves with the distal frame post 104 of the screen door 100 which pulls the secondary door 220 away from the central portion 208 of the vehicle 10.

Cooling capability from air flow through the screen door 100 would be increased by more screen surface 110 and less structural support for the screen door 100, as the structural support can interfere with air flow. However, with less structural support, the weight of the secondary door 220 at the distal frame post 104 of the screen door 100 can cause a twisting and deformation of the screen door 100 shown be arrow 310 which can be detrimental to the screen door 100.

Figure 5:
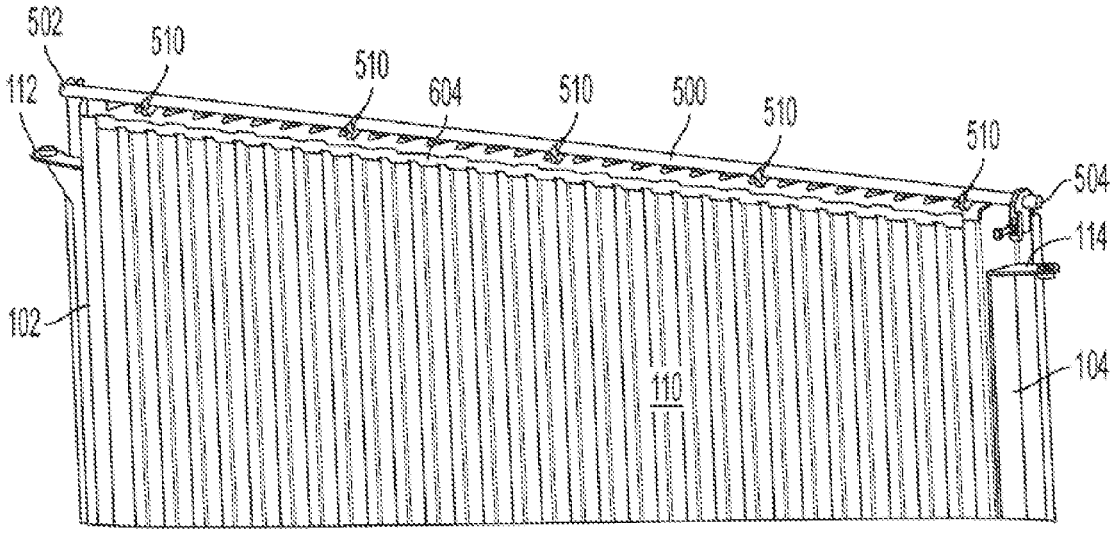
FIG. 5 illustrates an exemplary embodiment of the top portion of the screen door with the top cover removed from the upper frame member to show the torsion rod extending between the proximal and distal frame posts and to show the guides.

The screen door 100 can include one or more torsion rods 500 that extend between the proximal and distal frame posts 102, 104. and the torsion rods 500 can be housed in the upper and/or lower frame members 106, 108 of the screen door 100. FIG. 5 illustrates the top portion of the screen door 100 with the top cover 602 removed from the upper frame member 106 to show the torsion rod 500 extending along the top of the screen surface 110 between the proximal and distal frame posts 102, 104. The torsion rod 500 extends from a proximal end 502 at the proximal frame post 102 to a distal end 504 at the distal frame post 104. The lower frame member 108 can also include a torsion rod 500 that extends along the bottom of the screen surface 110 between the proximal and distal frame posts 102, 104. The torsion rod 500 can pass through one or more guides 510 that are attached to the top cover 602 of the upper frame member 106. The torsion rod 500 is not attached to the guides 510 so that the torsion rod 500 can rotate freely in the guides 510. The guides 510 help prevent the torsion rod 500 from deflecting or curving as torsion is applied, and thus help keep the torsion rod 500 in a generally linear path between the proximal and distal frame posts 102, 104.

Figure 6:
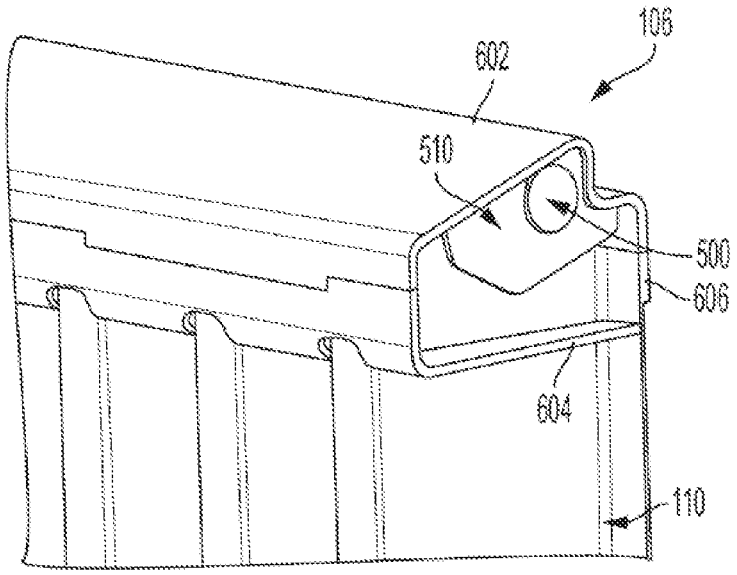
FIG. 6 illustrates a cross-section of an exemplary embodiment of the upper frame member showing the torsion rod and guide.

FIG. 6 illustrates a cross-section of an exemplary embodiment of the upper frame member 106 at the top of the screen door 100 showing the torsion rod 500 and guide 510. The upper frame member 106 can include a top cover 602, a front cover 604 and a rear cover 606 that form a housing around the torsion rod 500. The front cover 604 can have a sawtooth shape and the rear cover 606 can have a complementary sawtooth shape that helps maintain a pleated shape for the screen surface 110. The front cover 602 and the rear cover 606 can be welded to the top cover 602 to maintain a rigid housing shape. The one or more guides 510 can be welded to the top cover 602. The lower frame member 108 can include a bottom cover 612, a front cover 614 and a rear cover 616 that form a similar housing around a lower torsion rod 500. The front cover 614 can have a sawtooth shape and the rear cover 616 can have a complementary sawtooth shape that helps maintain the pleated shape for the screen surface 110.

Figure 7:
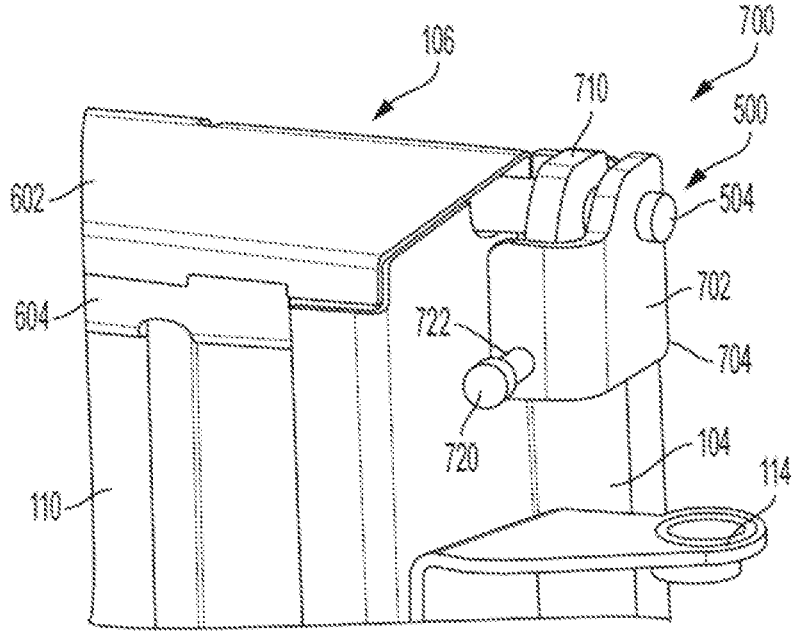
FIG. 7 illustrates an exemplary embodiment of a torsion applying assembly at the upper end of the distal side of the screen door where it connects to the secondary door using the second hinges.
Figure 8:
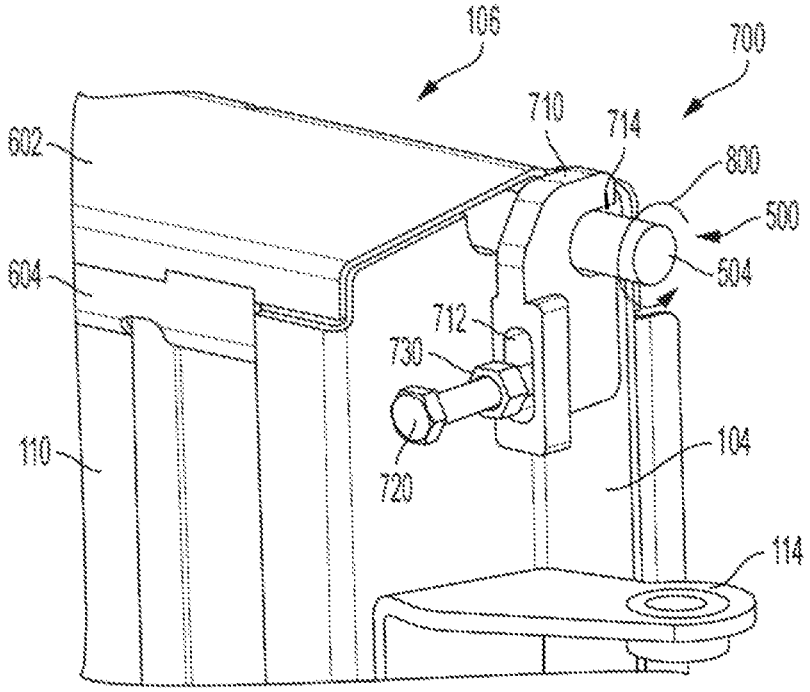
FIG. 8 illustrates the exemplary torsion applying assembly of FIG. 7 with the torsion bracket removed to show additional components and connections.

FIG. 7 illustrates an exemplary embodiment of a torsion applying assembly 700 at the upper end of the screen door 100 at the side where it connects to the secondary door 220 using the second hinges 114. The exemplary torsion applying assembly 700 includes a torsion bracket 702, a stationary support 710 and a fastener 720 which in this embodiment is a jack screw 720. FIG. 8 illustrates the exemplary torsion applying assembly 700 with the torsion bracket 702 removed to show a slot 712 in the stationary support 710 and an adjustment member 730 on the jack screw 720 between the torsion bracket 702 and the stationary support 710. FIG. 8 also shows a rod opening 714 in the stationary support 710 which the torsion rod 500 passes through.

The torsion bracket 702 is fixedly attached or welded to the distal end 504 of the torsion rod 500. The torsion bracket 702 is not directly attached to the distal frame post 104, and the torsion bracket 702 can twist relative to the distal frame post 104 such that a back edge of the torsion bracket 702 can twist or rotate behind the distal frame post 104. The torsion bracket 702 includes a fastener connection 722 where the fastener 720 is connected to the torsion bracket 702. In the embodiment with a jack screw for the fastener 720, the fastener connection 722 can be a threaded hole 722 in the torsion bracket 702, where the jack screw 720 is threaded through the threaded hole 722 in the torsion bracket 702.

The stationary support 710 is fixedly attached or welded to the distal frame post 104 of the screen door 100. The torsion rod 500 passes through the rod opening 714 in the stationary support 710 and the torsion rod 500 can rotate freely in the rod opening 714 of the stationary support 710. The jack screw 720 is threaded through the adjustment member 730 and passes into the slot 712. The jack screw 720 can move vertically in the slot 712, and the slot 712 keeps the jack screw 720 aligned substantially perpendicular to the torsion rod 500. The adjustment member 730 is too large to pass into the slot 712, and can rest against the face of the slot 712 on the stationary support 710.

The proximal end 502 of the torsion rod 500 can be fixedly connected to the proximal frame post 102 of the screen door 100, for example by welding, bolting or other fixed connection. The torsion rod 500 initially has no twisting relative to the proximal and distal side posts 102, 104 of the screen door 100. In this state when the screen door 100 is opened, the weight of the secondary door 220 would pull down on the distal frame post 104 of the screen door 100 and twist the screen door 100 in the direction of arrow 310 shown in FIGS. 3 and 4.

The jack screw 720 can be threaded all of the way to the head of the jack screw 720 or partially along the length of the jack screw 720. The jack screw 720 can be threaded the entire length from the threaded hole 722 in the torsion bracket 702 through the adjustment member 730 and into the slot 712 of the stationary support 710. Screwing the jack screw 720 into the torsion bracket 702 causes the jack screw to screw through the adjustment member 730 and into the slot 712. Since the distal end 504 of the torsion rod 500 is fixedly connected or welded to the torsion bracket 702, as the jack screw 720 screws through the adjustment member 730 and into the slot 712, the distance between the torsion bracket 702 at the threaded hole 722 and the slot 712 decreases which rotates or twists the distal end 504 of the torsion rod 500 relative to the stationary support 710 and the distal frame post 104 of the screen door 100. Since the proximal end 502 of the torsion rod 500 is fixedly connected or welded to the proximal side post 102 and the distal end 504 of the torsion rod 500 is twisted relative to the distal frame post 104, this tightening of the jack screw 730 induces a torsion on the torsion rod 500 in the direction of arrow 800 shown in FIG. 8.

When the desired torsion is preloaded on the torsion rod 500 by screwing the jack screw 720 into the torsion bracket 702 as described above, the torsion on the torsion rod 500 in the direction of arrow 800 can substantially counteract the twisting and deformation of the screen door 100 in the direction of arrow 310 caused by the weight of the secondary door 220 pulling down on the distal frame post 104 of the screen door 100.

The lower frame member 108 can have a similar structure to the upper frame member 106 described above with a torsion rod 500 and torsion applying assembly 700. In this way, a torsion can be preloaded on the upper torsion rod 500 using the torsion applying assembly 700 on the upper frame member 106, and a contributing torsion can be preloaded on the lower torsion rod 500 using the torsion applying assembly 700 on the lower frame member 108. The combined torsions on the upper and lower torsion rods 500 can be used to substantially counteract the twisting and deformation of the screen door 100 caused by the weight of the secondary door 220 pulling down on the distal frame post 104 of the screen door 100.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. An adjustable door for attachment to a structural member, the adjustable door comprising:

a proximal frame post on a proximal end of the adjustable door, the proximal frame post hingedly coupled to the structural member;

a distal frame post on a distal end of the adjustable door;

a torsion rod with a proximal end fixedly attached to the proximal frame post and a distal end moveable relative to the distal frame post; and a torsion applying assembly coupled to the distal frame post and coupled to the torsion rod, the torsion applying assembly configured to apply and maintain an adjustable torsion on the torsion rod.

2. The adjustable door of claim 1, wherein the torsion applying assembly comprises:

a stationary support fixedly attached to the distal frame post; and a torsion bracket fixedly attached to the distal end of the torsion rod, the torsion bracket moveable relative to the stationary support; and movement of the torsion bracket with respect to the stationary support is configured to apply the adjustable torsion on the torsion rod.

3. The adjustable door of claim 2, wherein the torsion applying assembly further comprises a fastener configured to maintain the torsion bracket in a desired position relative to the stationary support, the fastener configured to maintain the adjustable torsion on the torsion rod.

4. The adjustable door of claim 3, wherein the fastener is connected to the torsion bracket at a fastener connection, and the fastener maintains an adjustable distance between the stationary support and the fastener connection of the torsion bracket to maintain the adjustable torsion on the torsion rod.

5. The adjustable door of claim 4, wherein the stationary support includes a fastener opening, the fastener extends into the fastener opening and is moveable within the fastener opening.

6. The adjustable door of claim 2, wherein the stationary support includes a rod opening, the distal end of the torsion rod extends into the rod opening and the distal end of the torsion rod rotates freely in the rod opening.

7. The adjustable door of claim 6, wherein the torsion applying assembly further comprises:

a fastener configured to maintain the torsion bracket in a desired position relative to the stationary support; and the torsion bracket includes a fastener connection where the fastener is connected to the torsion bracket, and the fastener maintains an adjustable distance between the stationary support and the fastener connection of the torsion bracket to maintain the adjustable torsion on the torsion rod.

8. The adjustable door of claim 7, further comprising an adjustment member attached to the fastener between the torsion bracket and the stationary support; the adjustment member configured to adjust the adjustable distance between the stationary support and the fastener connection of the torsion bracket.

9. The adjustable door of claim 2, further comprising:

an upper frame member that extends between the proximal frame post and the distal frame post; and one or more guides fixedly attached to the upper frame member, wherein the torsion rod passes through the one or more guides and the torsion rod rotates freely in the one or more guides.

10. The adjustable door of claim 9, further comprising a screen surface that extends between the proximal and distal frame posts.

11. A multi-door system for attachment to a structural member, the multi-door door system comprising:

an adjustable door comprising:

a proximal frame post on a proximal end of the adjustable door, the proximal frame post hingedly coupled to the structural member;

a distal frame post on a distal end of the adjustable door;

a torsion rod with a proximal end fixedly attached to the proximal frame post and a distal end moveable relative to the distal frame post; and a torsion applying assembly coupled to the distal frame post and coupled to the torsion rod;

a secondary door including a proximal end adjacent to the distal end of the adjustable door; and an attachment mechanism that attaches the distal end of the adjustable door to the proximal end of the secondary door;

wherein the torsion applying assembly is configured to apply and maintain an adjustable torsion on the torsion rod of the adjustable door.

12. The multi-door system of claim 11, wherein the torsion applying assembly comprises:

a stationary support fixedly attached to the distal frame post of the adjustable door; and a torsion bracket fixedly attached to the distal end of the torsion rod, the torsion bracket moveable relative to the stationary support; and movement of the torsion bracket with respect to the stationary support is configured to apply the adjustable torsion on the torsion rod.

13. The multi-door system of claim 12, wherein the torsion applying assembly further comprises a fastener configured to maintain the torsion bracket in a desired position relative to the stationary support; the fastener configured to maintain the adjustable torsion on the torsion rod.

14. The multi-door system of claim 13, wherein the attachment mechanism comprises a hinge, and the hinge hingedly attaches the distal end of the adjustable door to the proximal end of the secondary door.

15. The multi-door system of claim 13, wherein the fastener is connected to the torsion bracket at a fastener connection, and the fastener maintains an adjustable distance between the stationary support and the fastener connection of the torsion bracket to maintain the adjustable torsion on the torsion rod.

16. The multi-door system of claim 15, wherein the stationary support includes a fastener opening, the fastener extends into the fastener opening and is moveable within the fastener opening.

17. The multi-door system of claim 16, wherein the stationary support includes a rod opening, and the distal end of the torsion rod extends into the rod opening and the distal end of the torsion rod rotates freely in the rod opening.

18. The multi-door system of claim 17, further comprising an adjustment member attached to the fastener between the torsion bracket and the stationary support; the adjustment member configured to adjust the adjustable distance between the stationary support and the fastener connection of the torsion bracket.

19. The multi-door system of claim 18, further comprising:

an upper frame member that extends between the proximal frame post and the distal frame post of the adjustable door;

one or more guides fixedly attached to the upper frame member; and a screen surface that extends between the proximal and distal frame posts adjacent to the upper frame member;

wherein the torsion rod passes through the one or more guides and the torsion rod rotates freely in the one or more guides.

20. The multi-door system of claim 19, wherein the attachment mechanism comprises a hinge, and the hinge hingedly attaches the distal end of the adjustable door to the proximal end of the secondary door.

* * * * *